US006945440B1

(12) United States Patent
Ford

(10) Patent No.: US 6,945,440 B1
(45) Date of Patent: Sep. 20, 2005

(54) PAINT BUCKET

(76) Inventor: Kevin B. Ford, 101 N. Wilson, Ulysses, KS (US) 67880

( * ) Notice: Subject to any disclaimer, the term of this patent is extended or adjusted under 35 U.S.C. 154(b) by 14 days.

(21) Appl. No.: 10/392,499

(22) Filed: Mar. 20, 2003

(51) Int. Cl.[7] ..... A45F 3/00; A45F 5/00

(52) U.S. Cl. ..... 224/148.6; 224/148.7; 224/679

(58) Field of Search ..... 224/148.1, 148.4–148.7, 224/677–679, 673, 241, 601, 615–617, 623, 224/625, 578, 257; 220/831, 832

(56) References Cited

U.S. PATENT DOCUMENTS

| | | | | |
|---|---|---|---|---|
| 2,169,080 A | | 8/1939 | Clark | |
| 3,283,971 A | | 11/1966 | Jones | |
| 3,351,970 A | * | 11/1967 | Engh | 224/625 |
| 3,997,092 A | * | 12/1976 | Pogwizd | 224/610 |
| 4,245,807 A | | 1/1981 | York | |
| 4,325,503 A | | 4/1982 | Swinney | |
| D286,949 S | * | 12/1986 | Hardman | 224/197 |
| 4,754,903 A | | 7/1988 | Dennis | |
| 4,915,278 A | * | 4/1990 | Smith | 224/601 |
| 4,972,982 A | | 11/1990 | Harbour | |
| 5,016,791 A | | 5/1991 | Burow | |
| 5,328,069 A | * | 7/1994 | Cohanfard | 224/257 |
| 5,390,838 A | | 2/1995 | Jafarkhani | |
| 5,489,051 A | * | 2/1996 | Robinson | 224/148.4 |
| 5,490,618 A | | 2/1996 | Davidson | |
| 5,791,534 A | | 8/1998 | Davis et al. | |
| 5,813,644 A | | 9/1998 | Bergin | |
| 5,915,606 A | | 6/1999 | Jensen | |
| 6,220,491 B1 | | 4/2001 | Wu | |
| 6,283,345 B1 | * | 9/2001 | Butschat | 224/148.4 |
| D464,484 S | | 10/2002 | Landen | |
| 6,719,178 B1 | * | 4/2004 | Taylor | 224/148.7 |

FOREIGN PATENT DOCUMENTS

| | | |
|---|---|---|
| GB | 2310358 A | 8/1997 |

* cited by examiner

*Primary Examiner*—Nathan J. Newhouse
(74) *Attorney, Agent, or Firm*—Kenneth H. Jack; Davis & Jack, LLC

(57) ABSTRACT

An assembly for carriage and storage of paint, the assembly consisting of an upwardly opening vessel having a rear wall, the rear wall having an upper end; a panel fixedly attached to the upwardly opening vessel or formed wholly with the upwardly opening vessel, the panel extending upwardly from the upper end of the rear wall of the vessel; a flexible strap having a pair of ends; and strap attaching hooks adapted for connecting the ends of the flexible strap to apertures extending through the panel, the hooks so connecting the ends of the flexible strap.

7 Claims, 3 Drawing Sheets

PAINT BUCKET

FIELD OF THE INVENTION

This invention relates to fluid carrying receptacles, containers, and vessels. More particularly, this invention relates to such articles which are adapted for carriage of paint.

BACKGROUND OF THE INVENTION

In the residential and commercial painting arts, large wall areas are commonly quickly painted through the use of paint rollers or through the use of paint sprayers. Preliminary to paint spraying or paint rolling large wall areas, a painter typically "cuts in" paint utilizing a common hand held paint brush, the "cut in" step occurring in the vicinity of the larger areas to be rolled or sprayed. Where, for example, an interior house painter engages in painting a room having four walls, a window, and a door, the "cut in" process includes paint brush painting peripherally around the door's trim and around the window's trim, brush painting at the floor line in close proximity with foot boards, brush painting at the ceiling line in close proximity with the room's ceiling or crown molding, and brush painting in all four corners of the room. While performing the brush painting "cut in" step, the painter repeatedly and frequently reloads his paint brush with paint. In order to efficiently perform "cut in" brush painting, the painter must keep a paint container in close proximity at all times. Where a common paint bucket having a handle is used during "cut in" painting, and where a painter is brush painting at ceiling level, such common paint bucket is typically placed on a step ladder's paint bucket shelf. However, placement of a common paint bucket upon a paint bucket shelf of a step ladder creates difficulties in repositioning the step ladder along a wall. Upon reaching a point where step ladder repositioning is needed, the painter typically steps down from the step ladder, grasping the paint brush in one hand. Thereafter, the painter must use his other hand to remove the paint bucket from the step ladder's paint bucket shelf, in order to free the step ladder for repositioning. However, at that point, both of the painter's hands are undesirably occupied, increasing the difficulty of and time required for repositioning the step ladder. Where the painter cuts in paint at mid-level along a wall, such as when painting around window trim, such common paint bucket is typically placed upon a floor surface, undesirably requiring the painter to repeatedly stoop to the floor in order to reload his brush.

The instant inventive paint bucket overcomes or ameliorates the above described deficiencies associated with use of common paint buckets during "cut in" painting by providing a paint bucket which is specifically adapted for convenient attachment around a painter's neck or around a painter's waist, and which further performs all of the traditional functions of a common paint bucket, as described above.

BRIEF SUMMARY OF THE INVENTION

A first major structural component of the instant inventive paint bucket comprises an upwardly opening container or vessel which is suitable for carrying liquid paint. Preferably, the upwardly opening vessel has a substantially flat under surface, allowing the vessel to rest with stability upon flat floor, table, or shelf surfaces, the flat bottom preventing toppling and spillage of paint. The upwardly opening vessel has a back side, and necessarily has a substantially rigid panel extending upwardly therefrom so that an upper edge of the panel overlies the rearward end of the upper opening of the vessel. Preferably, the panel is either fixedly and rigidly attached to the back side of the vessel, or the panel is formed wholly with the vessel, preferably by plastic injection molding.

A flexible neck strap is necessarily provided, and strap attaching means are further necessarily provided for interconnecting ends of the flexible strap with the panel. Preferably, the points of attachment of the strap with the panel are at hook apertures positioned at or near the panel's upper end.

A preferred strap attaching means comprises a combination of eyes or apertures extending through the panel and attachment hooks fixedly attached to ends of the flexible strap. Suitably, the strap attaching means may be alternately configured to comprise snap latch or buckle assemblies. Also suitably, the strap attaching means may be configured to comprise "velour crochet" flexible hook and fibrous pad combinations. Numerous other strap attaching means may be suitably substituted for the preferred hook and eye strap attaching means.

In use of the aforedescribed inventive paint bucket, a painter places the paint bucket upon a flat surface such as a floor, allowing the preferably flat bottom of the paint bucket to stabilize the paint bucket in an upright position. Thereafter, the painter pours paint into the upper opening of the vessel. Thereafter, assuming that the neck strap comprises the preferred hooks, the painter attaches the hooks of the neck strap to the preferred hook apertures extending through the panel, forming a neck loop. Thereafter, the painter raises the entire assembly, extending the neck loop over the painter's head, and allowing the paint filled vessel to suspend from the painter's neck, the rear surface of the paint bucket resting upon the painter's torso. In such configuration, the upwardly extending panel stabilizes the paint bucket upon the painter's torso, preventing excessive forward tilting of the vessel.

Preferably, the upwardly extending panel also has a pair of belt receiving slots, and preferably an end of the flexible strap, including strap attaching means, is fitted for passage through such slots. By providing such belt slots, the inventive paint bucket may conveniently be alternately worn by a painter about the painter's waist. Where the strap attaching means comprises the preferred hooks, the hooks may conveniently alternately interlock serving as a belt latching assembly.

In order to allow the inventive bucket to further perform a paint storage function while not in use during active painting, the upper lip of the upper opening of the vessel is preferably configured to receive a lid, and a fitted lid is preferably provided. Preferably, the lid is rearwardly hinged for motion from a first position wherein the lid closes and covers the vessel to a second position wherein the lid extends upwardly from its rear hinged attachment, opening the vessel. Means for holding the lid in its second position are provided, such means preferably releasably interconnecting the panel and the lid, while the lid is in its second position. A preferred releasable attaching means comprises a spring hook extending upwardly from the lid in combination with a spring hook receiving aperture extending through the panel. Configuration of the lid to include an upwardly extending spring hook allows the panel to further function as a component of the releasable attaching means. Other suitable means for releasably securing the lid in its second position comprise pin and eye fasteners, snap fasteners, "velour crochet" fasteners, or magnetic fasteners. Numerous other releasable attaching means falling with the scope of the invention may be suitably utilized.

Like the upwardly opening vessel and its upwardly extending panel, the lid is preferably fabricated by means of plastic injection molding, and the hinge preferably comprises a flexible or living hinge fabricated via the lid's injection mold. Other commonly known hinges such as double leaf hinges, pin and eye hinges, and lug and detent hinges may be suitably substituted for the preferred living hinge.

Accordingly, it is an object of the present invention to provide a paint bucket capable of performing substantially all of the functions of common lidded and handled paint buckets, while further performing functions for bodily attachment and for lid securing, through the provision of a flexible strap, a specially adapted upwardly extending panel, and hinged lid.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
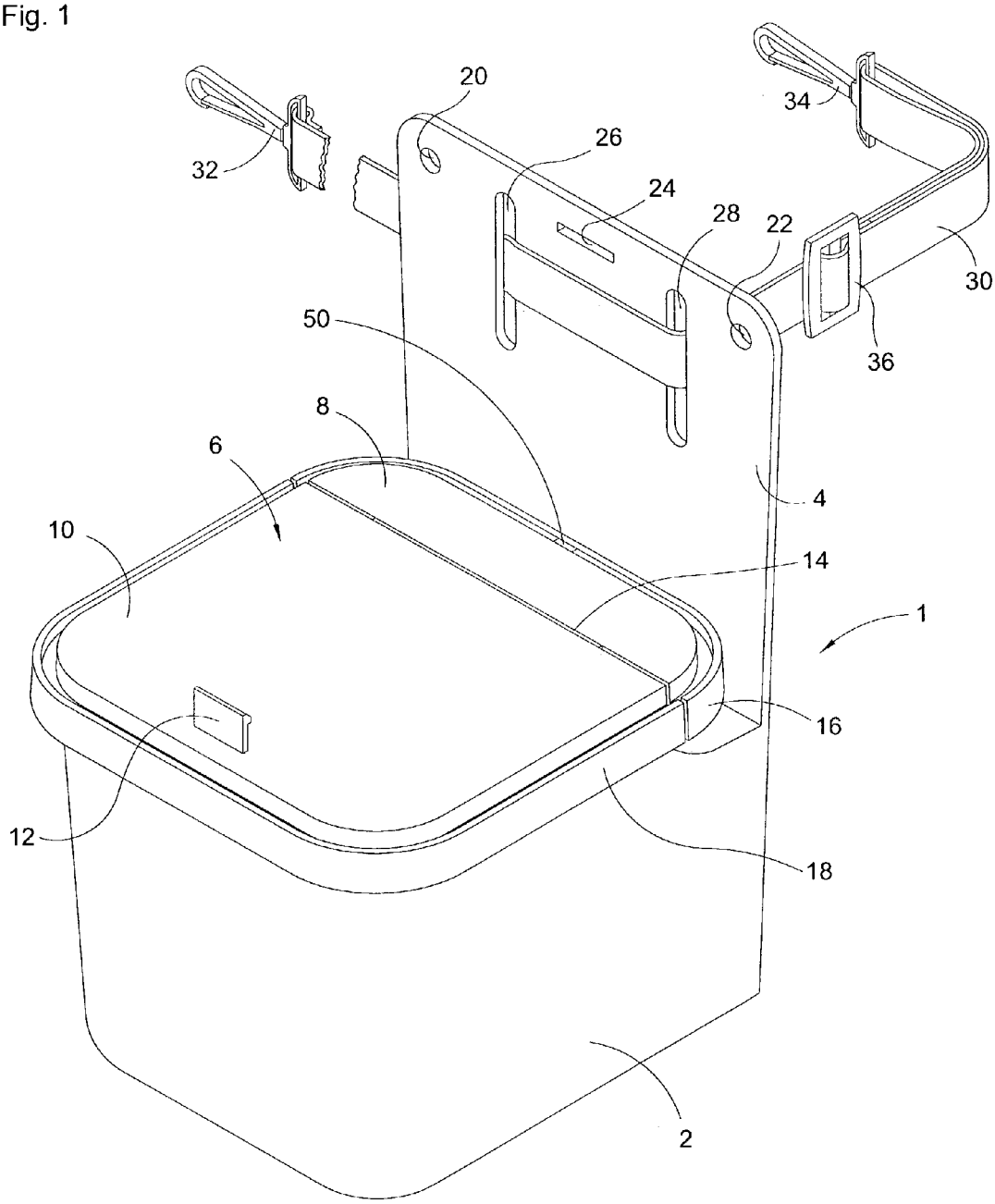
FIG. 1 is an isometric view of the instant inventive paint bucket.
Figure 2:
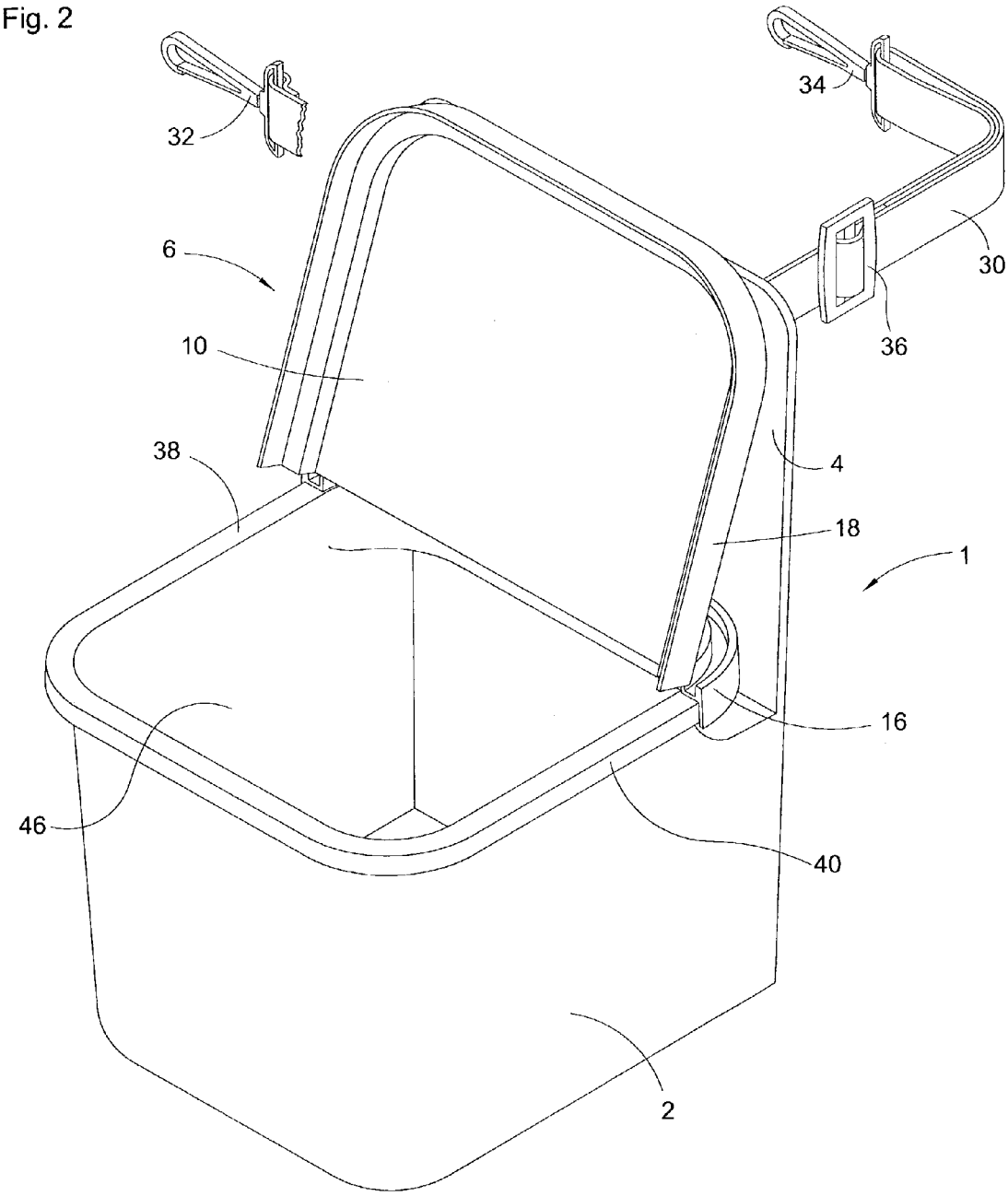
FIG. 2 redepicts FIG. 1 showing the lid of the inventive paint bucket in an opened position.
Figure 3:
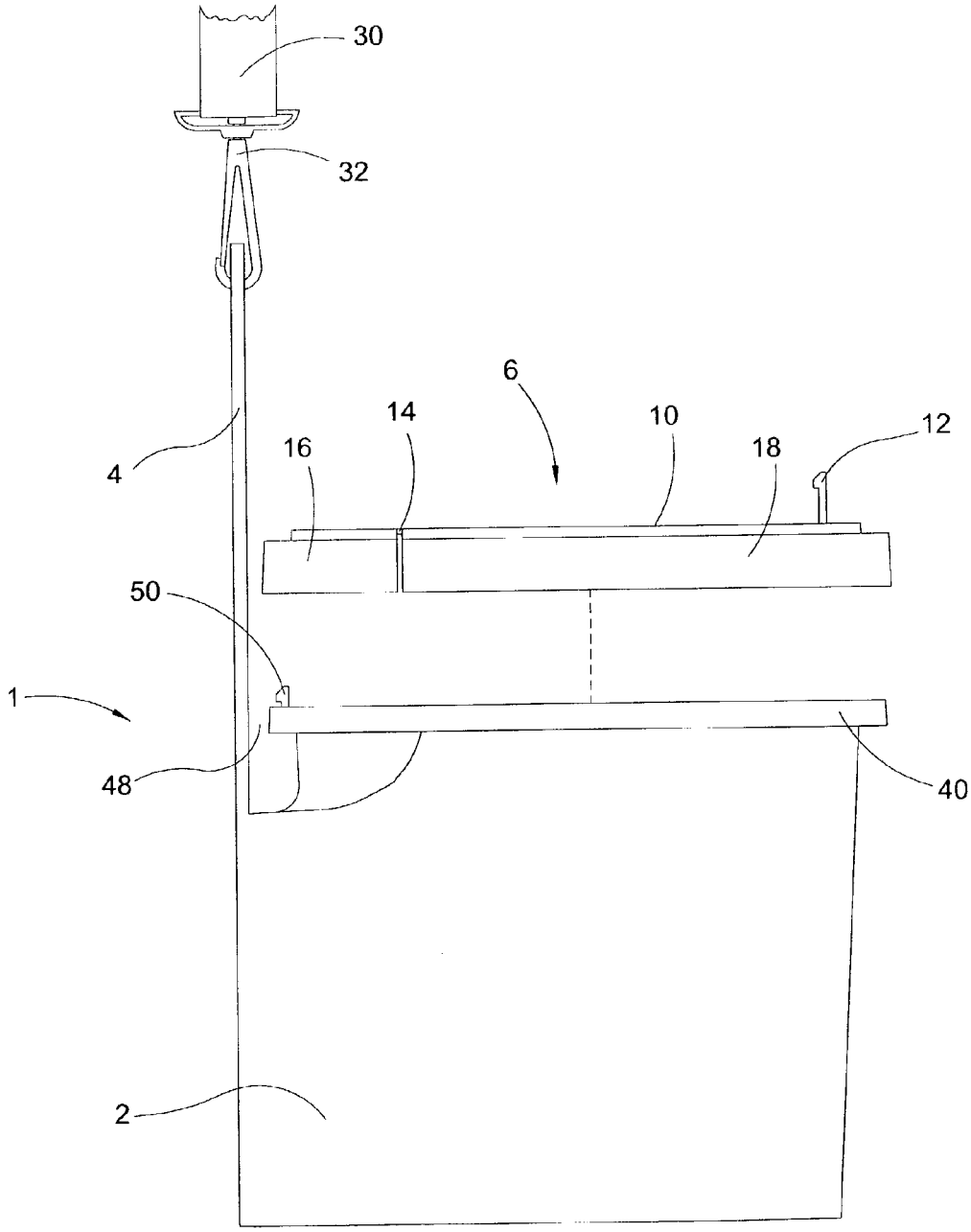
FIG. 3 is an exploded side view of the inventive paint bucket depicted in FIG. 1, the view showing a flexible strap attached in a different configuration.

Referring now to the drawings, and in particular to FIG. 1, the instant inventive paint bucket is referred to generally by Reference Arrow 1. The paint bucket 1 comprises an upwardly opening paint containing vessel 2 having a substantially rigid panel extending upwardly from the vessel's rear side. The panel 4 preferably has a pair of hook receiving eyes or apertures 20 and 22, a pair of belt slots 26 and 28, and the panel preferably has a spring hook receiving slot 24. Referring simultaneously to FIGS. 1 and 2, the upper opening 46 of vessel 2 preferably forms a peripheral outwardly extending lip 38 and downwardly extending flange 40. Referring further simultaneously to FIG. 3, the vessel 2 and the panel 4 are preferably fabricated in an injection molding process so that the rearward section of flange 40 is displaced forwardly away from the forward surface of panel 4, such displacement defining a lid flange receiving space 48. Preferably, a lid engaging snap hook 50 extends upwardly from lip 38.

Referring to FIG. 1, the instant inventive paint bucket 1 preferably comprises a lid which is referred to generally by Reference Arrow 6. The lid 6 preferably comprises a forward pivoting section 10 and a rearward fixed section 8, sections 10 and 8 preferably being interconnected by a living or flexible hinge 14. A flange 16 preferably extends peripherally and downwardly from section 8 of the lid 6, and flange 18 preferably similarly extends from the forward section 10. Referring simultaneously to FIGS. 1 and 3, the inner peripheral surfaces of flanges 18 and 16 are preferably closely fitted to the outer peripheral surface of flange 40, allowing flanges 16 and 18 to securely compress against and grasp lip surface 40. The snap hook 50 preferably extends upwardly through a snap hook receiving aperture (not within view) within the rear section 8, the snap hook further securing the lid 6 in place. Alternately, referring to FIG. 3, in absence of snap hook 50, the gap 48 between panel 4 and flange 40 may be closely fitted for grasping receipt of flange 16. The lid 6 preferably further comprises a spring hook 12 extending upwardly from lid section 10.

Referring to FIG. 1, a flexible strap 30 having swivel hooks 32 and 34, and having a take up buckle 36 is preferably provided. At least one of the swivel hooks 32 or 34 is preferably fitted for passage through belt slots 26 and 28. Upon attachment of hook 32 to aperture 20, and upon attachment of hook 34 to aperture 22 in the configuration depicted in FIG. 3, the strap 30 effectively serves as a neck suspension strap. In the belt strap configuration depicted in FIG. 1, hooks 32 and 34 may effectively serve as a belt latch or buckle, hook 32 connecting with hook 34.

Referring to FIG. 1, in use the inventive paint bucket 1 may be placed upon a flat surface, allowing its substantially flat bottom to stabilize and support the paint bucket. Thereafter, a user may grasp and upwardly pull against the forward end of the forward section 10 of lid 6, pivotally moving said section 10 upwardly and rearwardly about hinge 14. Upon continuation of such pivotal motion, the spring hook 12 which extends upwardly from the upper surface of section 10 extends into and latchingly engages slot 24, securing the lid section 10 in its upwardly extending and open position. Thereafter, referring further to FIG. 2, paint may be poured into the upper opening 46 of the vessel 2. Thereafter, flexible strap 30 may be extended about the user's waist, the user interlocking hooks 32 and 34 upon complete extension. Thereafter, take up buckle 36 may be manipulated to tighten and secure the flexible strap 30 about the user's waist. Upon adoption of such configuration, panel 4 serves multiple functions of strap attachment, paint bucket stabilization, affixing lid section 10 in its upwardly extended position and, referring further to FIG. 3, securing the rear section 8 of lid 6 against flange 40 through alternate close fitting of gap 48. Alternately, flexible strap 30 may be configured as a neck suspension loop as described above and as depicted in FIG. 3.

Referring simultaneously to FIGS. 1 and 2, upon cessation of usage of the inventive paint bucket 1 for active painting, the strap 30 may be removed from about the user's waist or neck, and the vessel 2 may be placed at rest upon a convenient flat surface. Thereafter, the user may extend fingers downwardly along the rear surface of panel 4 for engagement with the hook portion of spring hook 12, said portion extending rearwardly from aperture 24. Thereafter, the user may pull upwardly upon the end of hook 12 causing said hook to disengage from aperture 24. Thereafter, the forward section 10 of lid 6 may be pivotally moved forwardly and downwardly until flange 18 engages flange 40, effectively closing and covering the vessel 2. Upon assuming such closed configuration, the paint bucket 1 functions as a substantially air tight paint storing vessel.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for carriage and storage of paint, the assembly comprising:

(a) an upwardly opening vessel having a rear wall, the rear wall having an upper end;

(b) a panel fixedly attached to the upwardly opening vessel or formed wholly with the upwardly opening vessel, the panel extending upwardly from the upper end of the rear wall of the upwardly opening vessel;

(c) a flexible strap having a pair of ends;

(d) strap attaching means adapted for connecting the ends of the flexible strap to the panel, said means so connecting said ends;

(e) lid fitted for covering the upper opening of the upwardly opening vessel, the lid having a rear end, and further comprising hinged attaching means connecting the rear end of the lid to the vessel, the lid having a forward end and being capable of pivoting motion between first and second positions, the lid closing the vessel while in the first position, the lid extending upwardly while in the second position; and (f) releasable attaching means fixedly attached to or formed wholly with the panel, the releasable attaching means being adapted for holding the lid in its second position.

2. The assembly of claim 1 wherein the releasable attaching means comprises a spring hook and slot combination.

3. The assembly of claim 2 wherein the hinged attaching means comprises a living hinge.

4. The assembly of claim 3 wherein the strap attaching means comprises a pair of hook receiving apertures extending through the panel.

5. The assembly of claim 4 wherein the strap attaching means further comprises a pair of hooks fixedly attached to the ends of the flexible strap.

6. The assembly of claim 5 further comprising a pair of belt slots extending through the panel.

7. The assembly of claim 6 wherein at least a first hook among the pair of hooks is fitted for passage through the pair of belt slots.

* * * * *